US008033404B2

(12) United States Patent
Keller

(10) Patent No.: US 8,033,404 B2
(45) Date of Patent: Oct. 11, 2011

(54) MODULAR DOUBLE-SIDED DISPLAY PANEL

(76) Inventor: Jeffrey Steffen Keller, Logan, UT (US)

( * ) Notice: Subject to any disclaimer, the term of this patent is extended or adjusted under 35 U.S.C. 154(b) by 762 days.

(21) Appl. No.: 11/862,997

(22) Filed: Sep. 27, 2007

(65) Prior Publication Data

US 2008/0061018 A1 Mar. 13, 2008

Related U.S. Application Data

(60) Provisional application No. 60/847,387, filed on Sep. 27, 2006.

(51) Int. Cl.
*A47F 5/08* (2006.01)

(52) U.S. Cl. ..... 211/94.01

(58) Field of Classification Search ..... 211/94.01, 211/87.01, 189, 94.02; 248/224.41, 220.42; 52/36.5, 36.4; D25/58, 119, 123, 138
See application file for complete search history.

(56) References Cited

U.S. PATENT DOCUMENTS

| | | | | | |
|---|---|---|---|---|---|
| 4,607,753 | A | * | 8/1986 | Radek | 211/94.01 |
| 4,678,151 | A | * | 7/1987 | Radek | 248/223.41 |
| 4,805,783 | A | | 2/1989 | Mayer | |
| 4,825,601 | A | | 5/1989 | Halverson | |
| 5,101,986 | A | * | 4/1992 | Holztrager | 211/85.1 |
| 5,105,952 | A | * | 4/1992 | Krattiger | 211/40 |
| 5,148,925 | A | * | 9/1992 | Althoff et al. | 211/40 |
| 5,228,579 | A | * | 7/1993 | Kaufman | 211/94.01 |
| 5,412,912 | A | | 5/1995 | Alves | |
| D393,909 | S | | 4/1998 | Current | |
| 6,134,846 | A | * | 10/2000 | Lamb | 52/36.5 |
| 6,164,467 | A | * | 12/2000 | DePottey et al. | 211/189 |
| 6,421,961 | B1 | * | 7/2002 | Mallozzi | 52/36.5 |
| D471,993 | S | | 3/2003 | Holztrager | |
| D473,664 | S | | 4/2003 | Perkins et al. | |
| D482,802 | S | | 11/2003 | Yates, Jr. | |
| D507,355 | S | | 7/2005 | Fischer | |
| D511,581 | S | | 11/2005 | Holztrager | |
| 6,971,614 | B2 | * | 12/2005 | Fischer et al. | 248/220.43 |
| 7,104,023 | B1 | | 9/2006 | Holztrager | |
| 7,117,998 | B2 | * | 10/2006 | Krapf | 211/45 |
| D532,120 | S | | 11/2006 | Holztrager | |
| D533,283 | S | | 12/2006 | Holztrager | |
| 7,198,159 | B2 | | 4/2007 | Fischer | |
| 2005/0006539 | A1 | | 1/2005 | Fischer et al. | |
| 2005/0193641 | A1 | | 9/2005 | Fischer | |
| 2006/0091094 | A1 | * | 5/2006 | Schuberth | 211/94.01 |
| 2007/0221594 | A1 | * | 9/2007 | Pierro | 211/94.01 |
| 2008/0000862 | A1 | * | 1/2008 | Lawson | 211/94.01 |

* cited by examiner

*Primary Examiner* — Jennifer E. Novosad
(74) *Attorney, Agent, or Firm* — Swanson & Bratschun, L.L.C.

(57) ABSTRACT

A modular double-sided display panel including multiple slat members. Each slat member has an upper engagement portion and a lower engagement portion. A panel may be constructed from multiple slat members by serially interconnecting generally horizontally disposed slat members in a vertical chain. In particular, the serial interconnection between adjacent slat members occurs by placing the lower engagement portion of a first slat member over the upper engagement portion of an adjacent second slat member in a substantially vertical chain until a suitable number of slats have been thus interconnected. The assembled slat members will define two opposing surfaces, each of which can receive hooks, supports or other display apparatus.

9 Claims, 10 Drawing Sheets

MODULAR DOUBLE-SIDED DISPLAY PANEL

RELATED APPLICATIONS

This application claims priority from U.S. Provisional Patent Application Ser. No. 60/847,387, filed Sep. 27, 2006, entitled "Slatwall Or Wall Made For Display Or Storage With Artistic Appeal," which is hereby incorporated by reference.

TECHNICAL FIELD

A modular double-sided display panel and more particularly a display panel including a plurality of interconnected slat members which define two opposing hook receiving surfaces.

BACKGROUND ART

Retailers and other persons frequently use slatwall panels or similar fixtures to hold and display merchandise. A conventional slatwall features panels which are fabricated from wood, metal or another suitable material and typically have slots or other structures milled into a face of the slatwall. The slots or other structures are configured to receive display hooks, shelves or other merchandise supports.

Typical slatwalls may be fabricated as panels of various sizes which are secured to existing interior building walls or, alternatively, assembled into free-standing structures. Typical slatwall panels can be large or heavy and thus inconvenient to move, limiting the utility of conventional slatwall structures for temporary use such as at a tradeshow.

DePottey, et al., U.S. Pat. No. 6,164,467, addresses some of the shortcomings exhibited by typical slatwall panels for use as temporary or mobile displays. In particular, DePottey teaches a modular system where a freestanding slatwall structure is made up of individual slat members stacked one upon the other and supported by appropriately spaced upright support members. Each of the panels assembled from individual slat members has a front side which is configured to receive support hooks or other attachment devices and a back side which will not receive hooks. Thus, if a two-sided display panel is desired, DePottey expressly teaches that two separate panels be attached to a support structure in a back-to-back fashion.

Radek, U.S. Pat. No. 4,607,753, teaches a similar modular slatwall structure which includes horizontally oriented slats held in a vertical arrangement by supports. As was the case with the structure taught by DePottey, the Radek structure, when assembled, forms a panel which is only suitable for receiving slatwall hooks or other supporting devices on one side.

Mayer, U.S. Pat. No. 4,805,783, does teach a two-sided slatwall advertising panel. The individual slats of Mayer are however relatively complex extruded shapes which have flanges and channels formed therein which provide for interconnection between adjacent slats. The Mayer slats must be relatively precisely fabricated to provide for appropriately rigid interconnection. In addition, the slats must be slid transversely or lengthwise with respect to each other to interconnect. Thus, the apparatus of Mayer may be relatively difficult to assemble.

The present disclosure includes embodiments directed toward overcoming one or more of the problems discussed above.

SUMMARY OF THE INVENTION

One embodiment is a modular double-sided display panel. The modular double-sided display panel includes multiple slat members. Each slat member has an upper engagement portion and a lower engagement portion. A panel may be constructed from multiple slat members by serially interconnecting generally horizontally disposed slat members in a vertical chain. In particular, the serial interconnection between adjacent slat members occurs by placing the lower engagement portion of a first slat member over the upper engagement portion of an adjacent second slat member in a substantially vertical chain until a suitable number of slats have been thus interconnected.

The serial interconnection between adjacent slat members can occur without sliding either slat member transversely, since the upper engagement portion and lower engagement portion of respective slats are configured to hook directly over each other without the need for any sliding motion. When the plurality of slat members are assembled into a modular double-sided display panel, the slat members will define two opposing surfaces, each of which can receive hooks, supports or other display apparatus.

Each of the plurality of interconnected slat members may have a substantially identical cross-sectional profile. In addition, the modular double-sided display panel may include a frame connected to the plurality of interconnected slat members providing support and structure.

If present, the frame may include feet, legs or other supports necessary to allow the double-sided display panel to operate as a free-standing structure. The free-standing structure may include more than one display panel. In addition, if the free-standing structure includes more than one display panel, the display panels may be disposed in multiple planes. For example, complex structures such as crosses, triangles, boxes or other free-standing structures may be assembled from and defined by a suitable frame system.

An alternative embodiment is a modular double-sided display panel also including multiple slat members. In this second embodiment, each slat member has a base and two sides extending from the base at an acute angle such that each slat member has a partial trapezoidal cross-section which is open opposite the base. In this embodiment, the double-sided display panel is built by serially interconnecting the sides of adjacent slat members. Interconnection requires that each adjacent slat base be faced in an opposite direction from its neighbors. Thus, the partial trapezoidal cross-section of the interconnected slat members of this embodiment define two opposing surfaces, each of which may receive hook or other supports.

This embodiment may include a frame attached to the interconnected slat members to provide support. The frame may be configured to create a free-standing structure. The free-standing structure may have display panels in more than one plane.

Another embodiment is a modular display curtain. The modular display curtain includes a plurality of generally horizontal interconnected slat members hung one from another in a generally vertical alignment. The display curtain differs from other embodiments in that the display curtain is not supported by a frame or other structure along the sides. In particular, the display curtain may be supported only by the interconnection between slat members and an attachment of the top slat member to a structure.

Alternatively, the display curtain may also be attached at the bottom slat member to a structure. In this embodiment, the interconnected slat members create a display curtain which is attached at only the top and bottom but otherwise supported only by interconnections between the slats.

The slat members of the modular display curtain may have an upper engagement portion and a lower engagement portion. Thus, the display curtain may be assembled by serially interconnecting the lower engagement portion of one slat member with the upper engagement portion of an adjacent slat member without sliding either slat member transversely. Alternatively, each slat member may comprise a base and two sides extending from the base at an acute angle, such that each slat member has a partial trapezoidal cross section which is open opposite the base. In this instance, serial interconnection may be made between the sides of select adjacent slat members. In either embodiment, the interconnected slat members may define two opposing hook receiving surfaces.

An alternative embodiment is a slat for use in a modular display panel. The slat will include a base and two sides extending from the base at an acute angle such that the slat has a partial trapezoidal cross section which is open opposite the base. In this embodiment, the slat will have no other structure which is material to the slat functioning as a component of a modular display panel.

DETAILED DESCRIPTION

Figure 1:
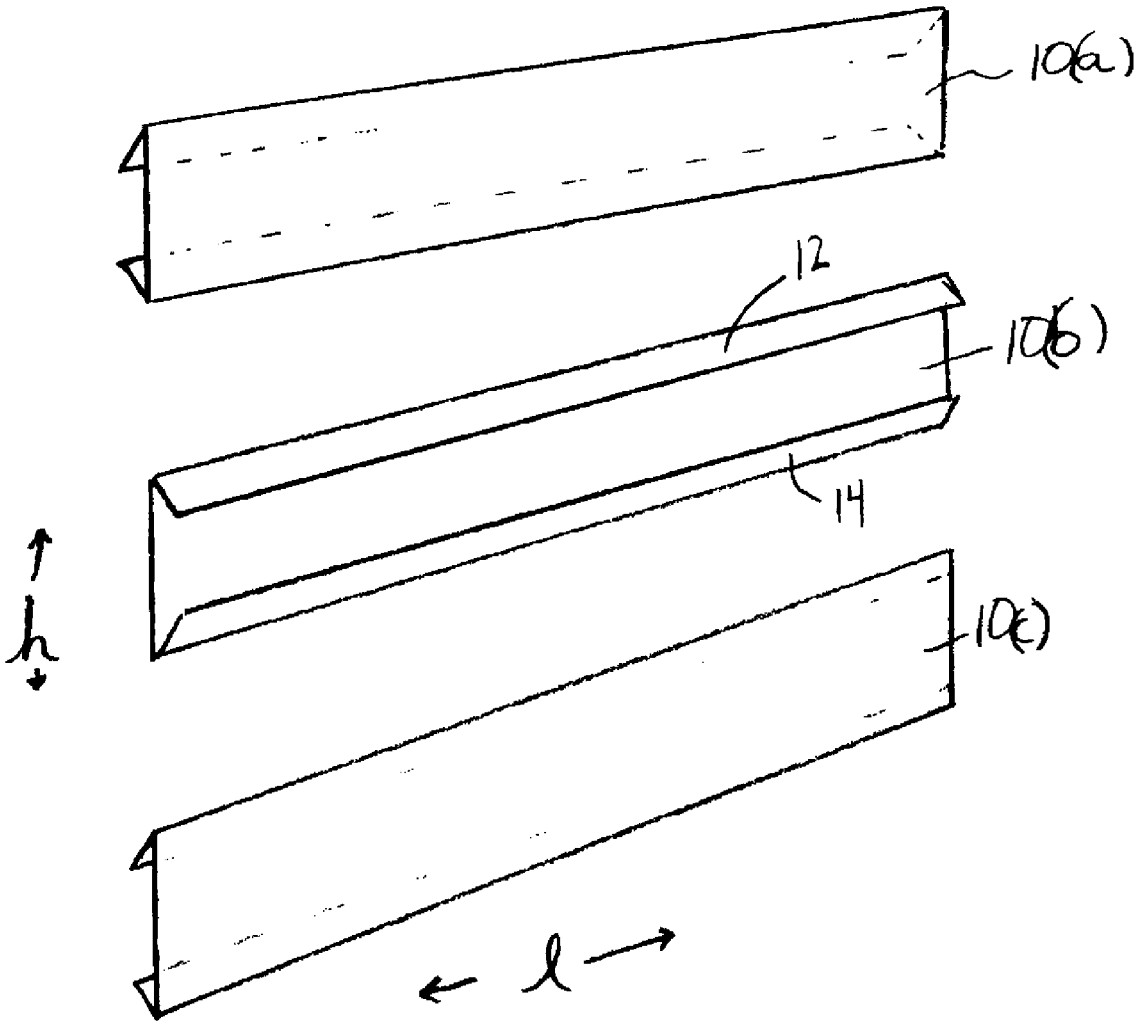
FIG. 1 is an exploded perspective view of three slat members.

FIG. 1 is a perspective view of three slat members 10. The slat members 10 have a length (l) which is typically greater than the slat member 10 height (h). The slat member 10 includes an upper engagement portion 12 and a lower engagement portion 14.

Figure 2:
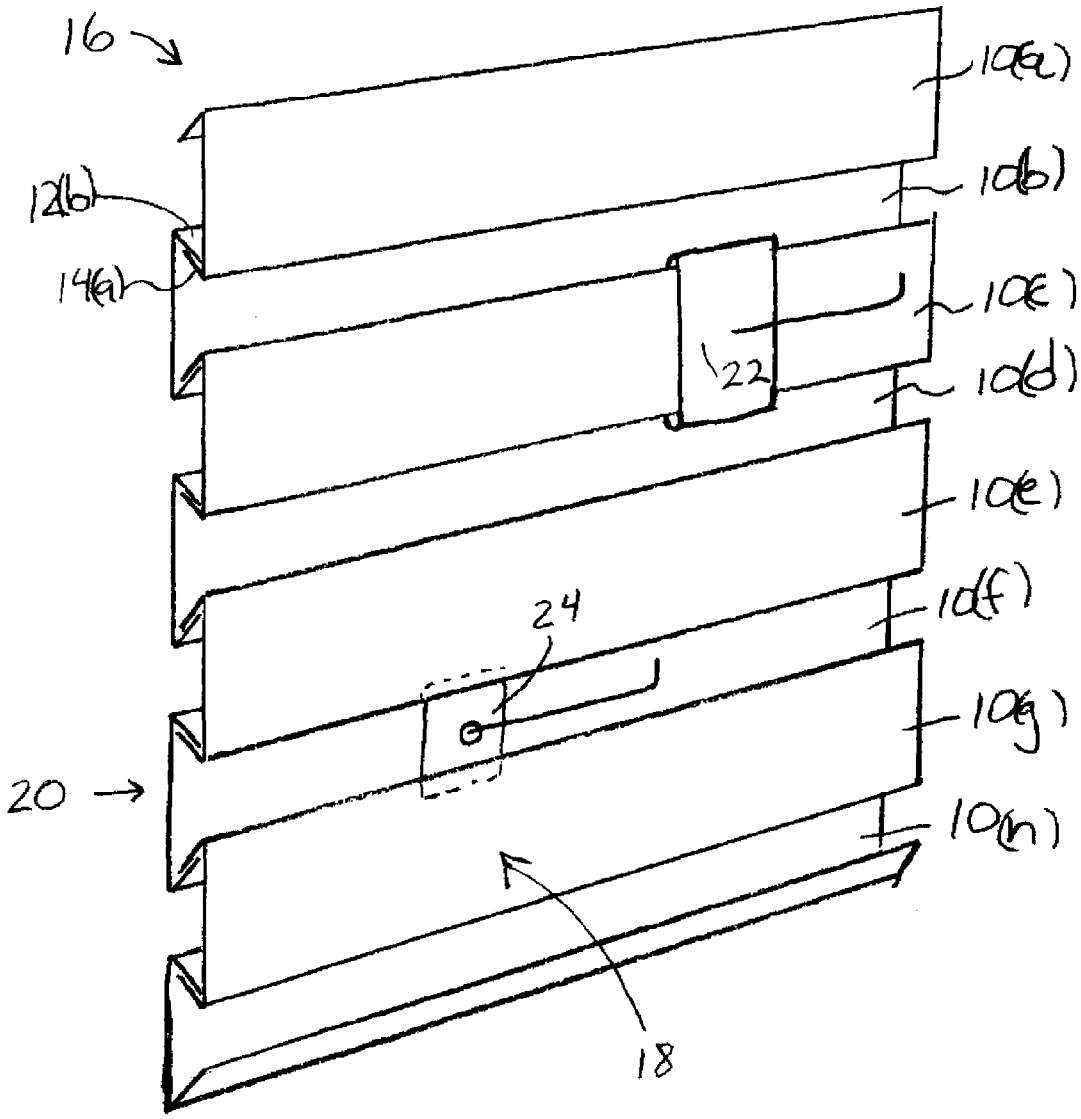
FIG. 2 is a perspective view of a double-sided display panel.
Figure 3:
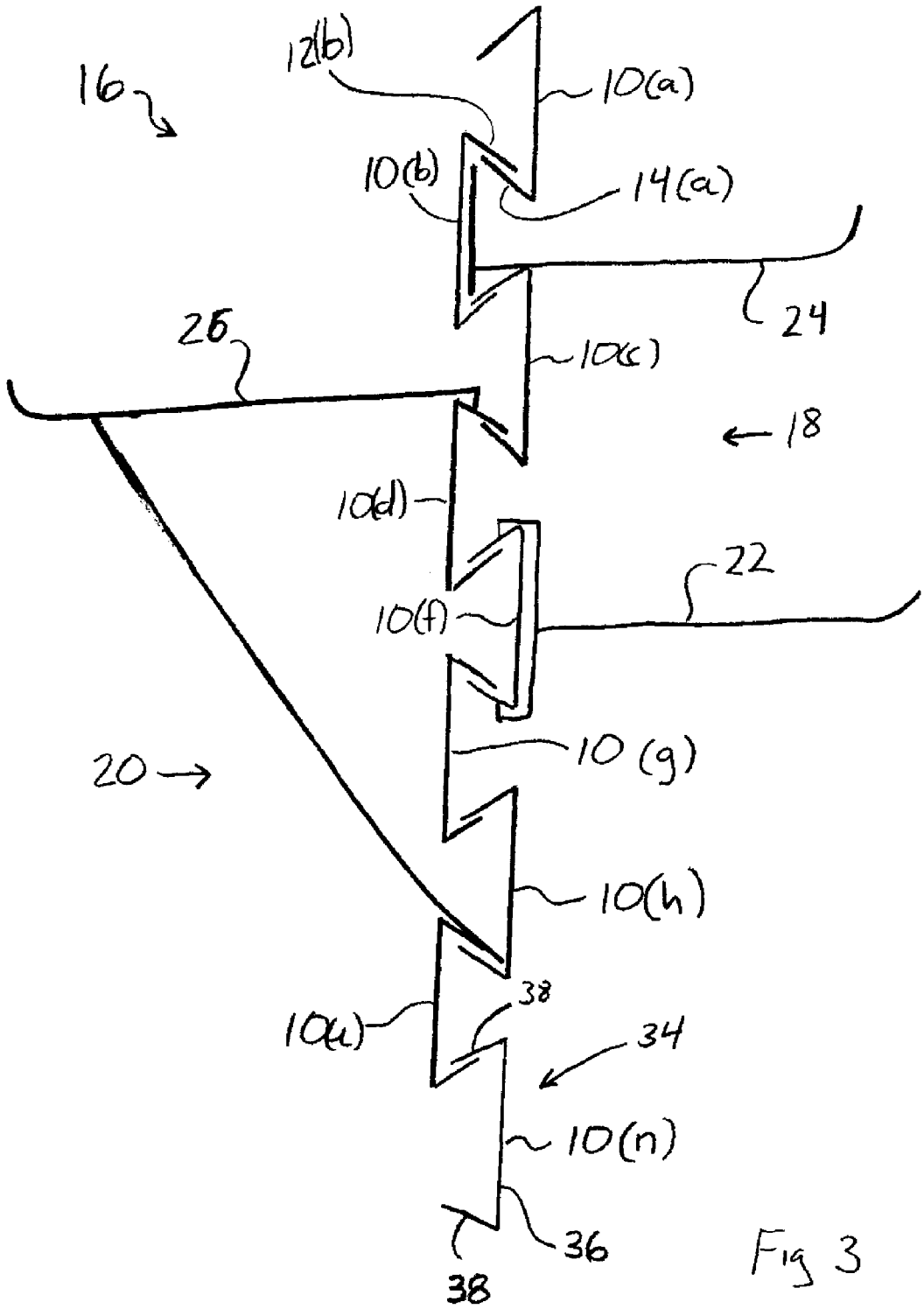
FIG. 3 is a side view of the double-sided display panel of FIG. 2.

As shown in FIGS. 2 and 3, multiple slat members 10 (*a, b, . . . n*) may be interconnected to form a display panel 16. The display panel may be formed by interconnecting the lower engagement portion of a first slat member (for example, lower engagement portion 14(*a*) as shown on FIGS. 2 and 3 with the upper engagement portion 12 of an adjacent slat member (for example, upper engagement portion 12(*b*) of FIG. 2).

Those skilled in the art will readily appreciate that the upper engagement portion 12 and lower engagement portion 14 of respective slat members 10 are configured in the embodiment of FIGS. 1 and 2, and all embodiments disclosed herein, to interconnect by directly placing one engagement portion over another. Thus, it is unnecessary to slide any slat member 10 transversely with respect to another slat member 10 to accomplish interconnection or engagement.

As shown on FIGS. 2 and 3, the serially interconnected slat members 10 define opposing front and back hook receiving surfaces 18 and 20, respectively.

As used herein, the term "hook" is defined as any slatwall hook, grid wall hook, shelving bracket, custom support, face-out, waterfall, hangrail, bracket, attachment, fixture, or other structure which is designed to engage with or otherwise removably attach to the hook receiving structure of a display panel 16. For example, grid wall hook 22 and slatwall hook 24 are, as shown in FIG. 2, provided with structure for coupling to different portions of the front hook receiving surface 18. A larger bracket/shelf support 26 is shown on FIG. 3. Any of these types of hooks 22, 24, 26 or other hook type structures could be attached to either the front hook receiving surface 18 or the back hook receiving surface 20. The embodiments disclosed herein are not limited to any particular style of hook or attachment structure. Nor are the embodiments disclosed herein limited to any particular front or rear hook receiving surface 18, 20 configuration, provided that the surfaces 18, 20 are configured to releasably receive some type of hook or support and that the slat members 10, when interconnected, define both surfaces.

Figure 4:
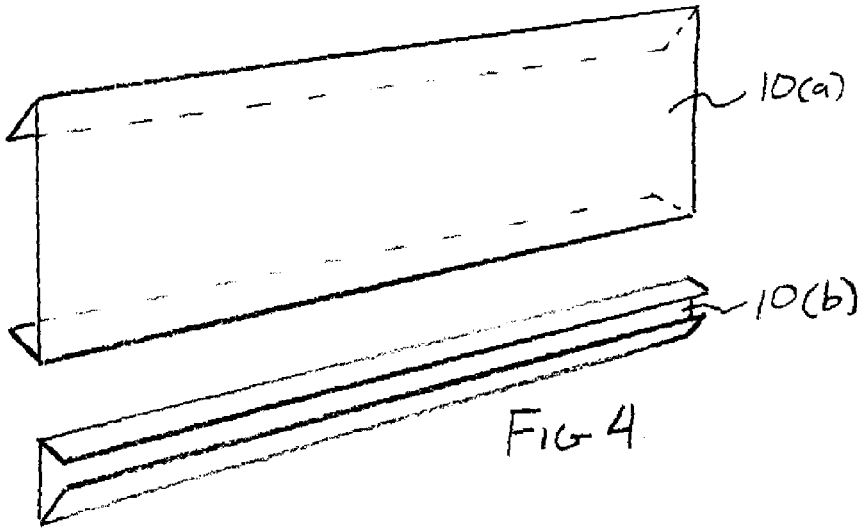
FIG. 4 is an exploded view of slat members having different cross-sectional sizes.
Figure 5:
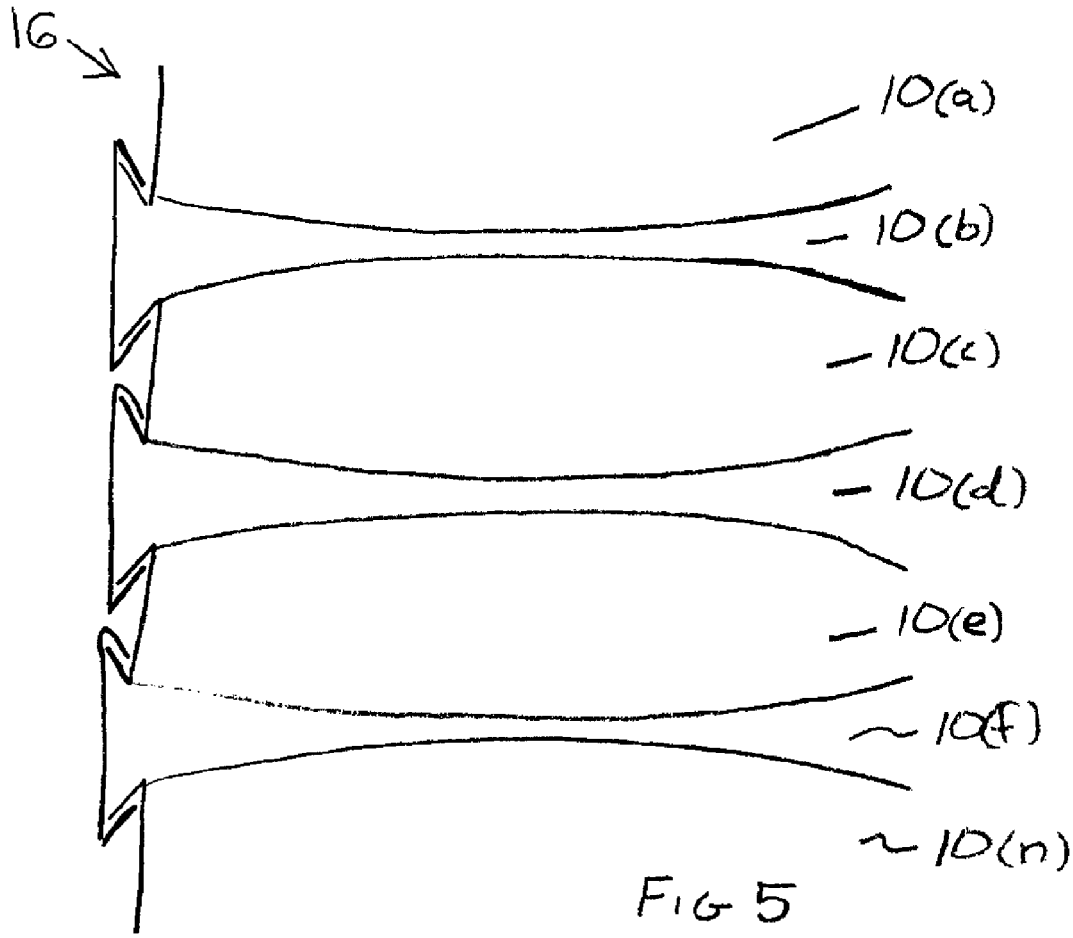
FIG. 5 is a perspective view of a display panel assembled from slat members having variable cross-sectional profiles.

The embodiment of FIGS. 1 and 2 feature slat members 10 which have substantially identical cross-sectional profiles. Alternative embodiments include slat members 10 where adjacent slat members 10 have different cross-sectional profiles or a varying cross-sectional profile. For example, FIG. 4 is an exploded perspective view of an alternative embodiment where slat member 10(*a*) has greater height than slat member 10(*b*). FIG. 5 is a perspective view of a display panel 16 assembled from slat members 10 having variable cross-sectional profiles.

Figure 6A:
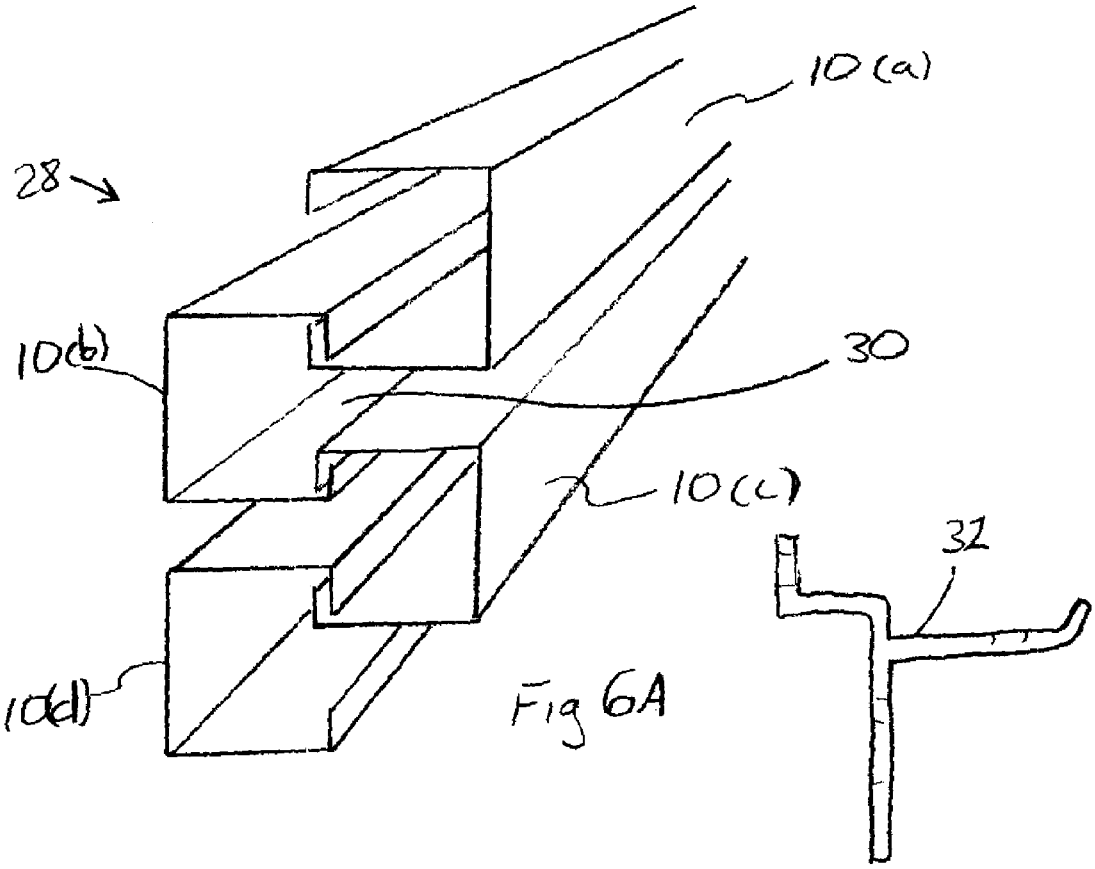
FIGS. 6A and 6B are perspective views of display panels assembled from slat members having alternative cross-sectional profiles.
Figure 6B:
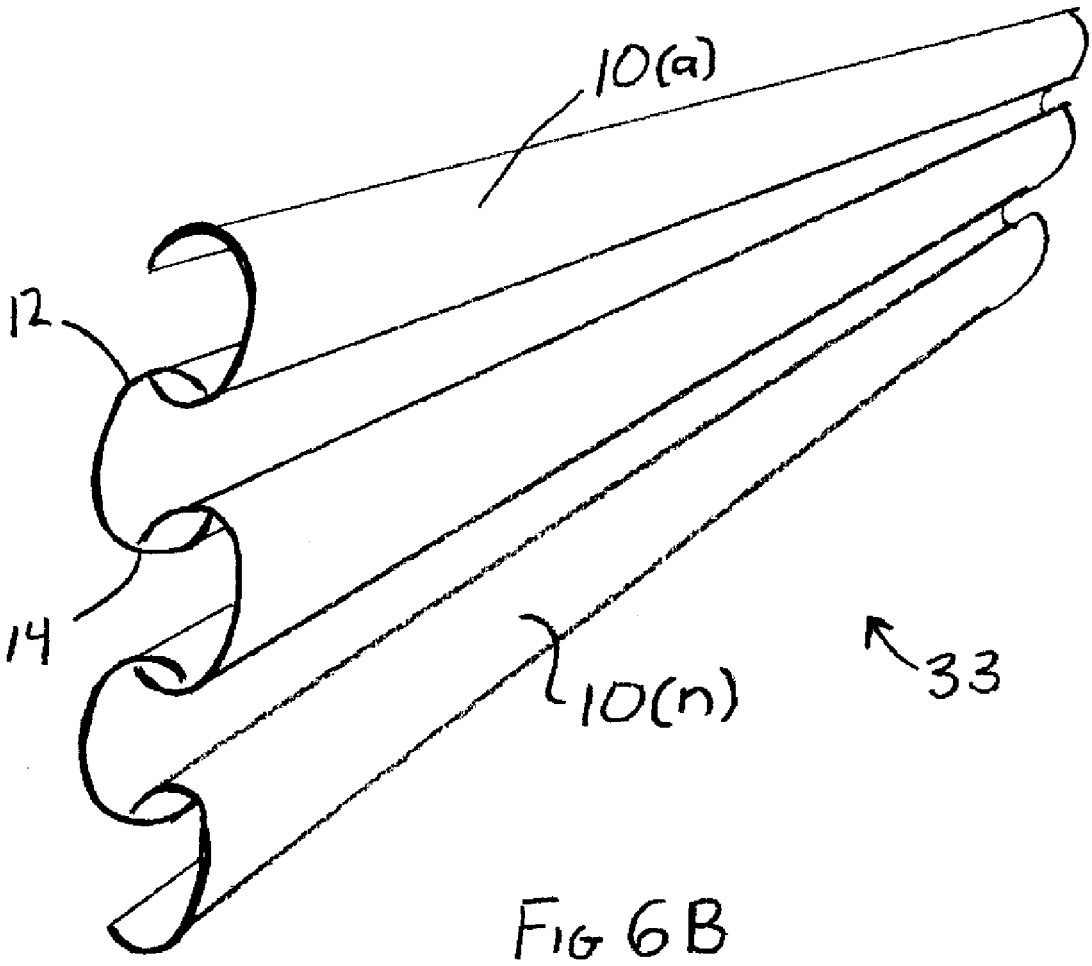

Alternative embodiments may feature slat members 10 which have cross-sectional profiles which are quite different from the cross-sectional profile disclosed in FIGS. 1-3. For example, FIG. 6A is a perspective view of a display panel 28 assembled from alternatively shaped slat members 10. The display panel 28 features conventionally shaped hook receiving slots 30 which may receive conventional slatwall hooks 32. Similarly, FIG. 6B is a perspective view of a display panel 33 assembled from curved slat members 10. Those skilled in the art will appreciate that the embodiments disclosed herein are not limited to any particular slat shape, size or cross-sectional profile. The embodiments are limited only in that a dual-sided display panel may be assembled from the slats. Each side of the display panel so assembled has a surface suitable for receiving and holding hooks or other support structures.

As described in detail above, slat members 10 may have virtually any cross-sectional profile which defines opposing hook receiving surfaces when multiple slat members 10 are serially interconnected. One cross-sectional profile which is particularly advantageous is an open top partial trapezoid as is best shown in FIG. 3. The partial trapezoid cross section 34 has a base 36 and two sides 38 which extend from the base at an acute angle. Thus, the base and two sides form the partial trapezoidal cross section 34 which is open opposite the base 36. The two sides 38 correspond to the upper engagement portion 12 and lower engagement portion 14 described in detail above. As shown in FIG. 3, when slat members 10 featuring a partial trapezoid cross-section 34 are interconnected to form a display panel 16, the base 36 of adjacent slat members 10 will face in opposite directions.

Figure 7:
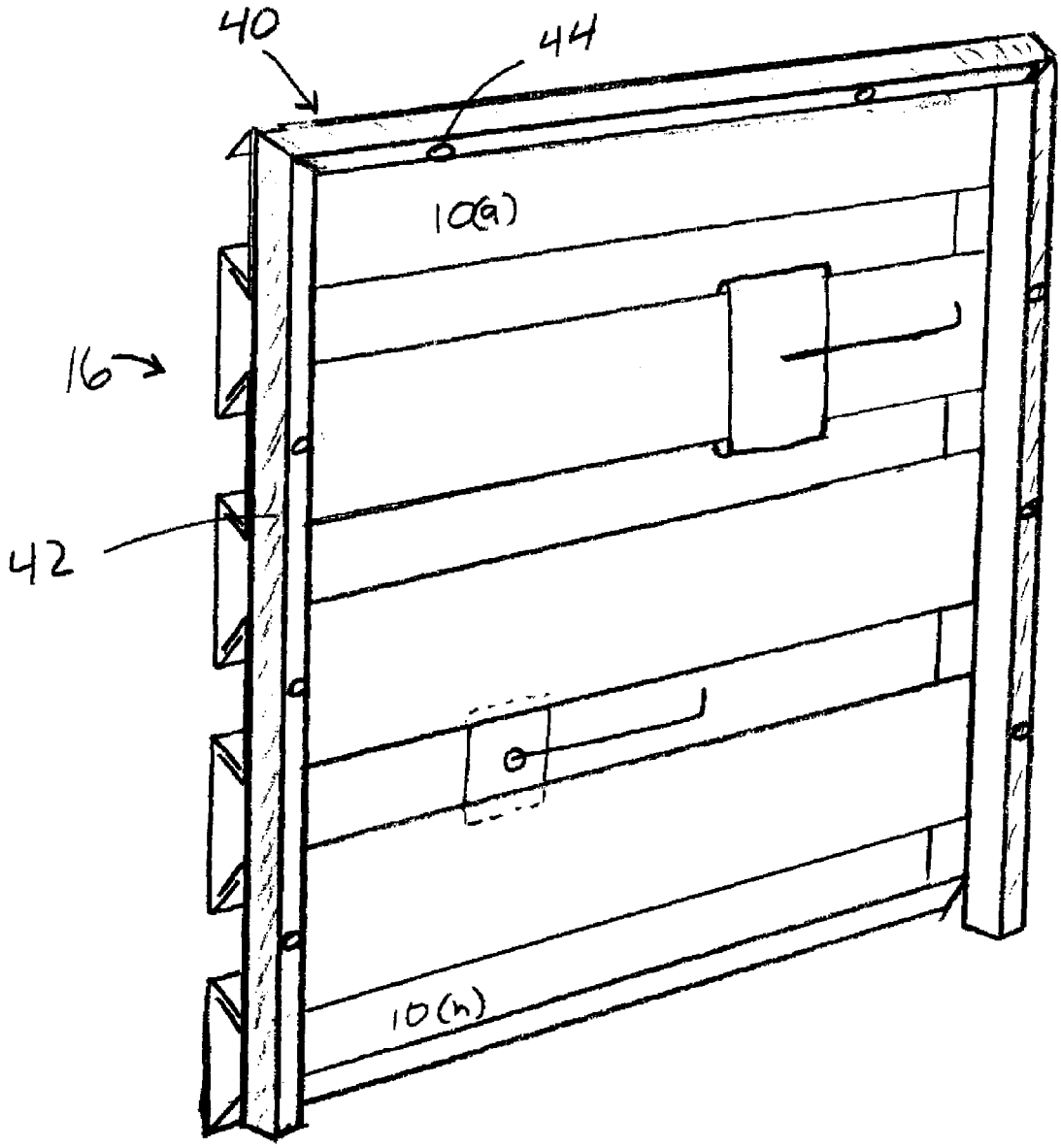
FIG. 7 is a perspective view of a display panel with a frame.
Figure 8:
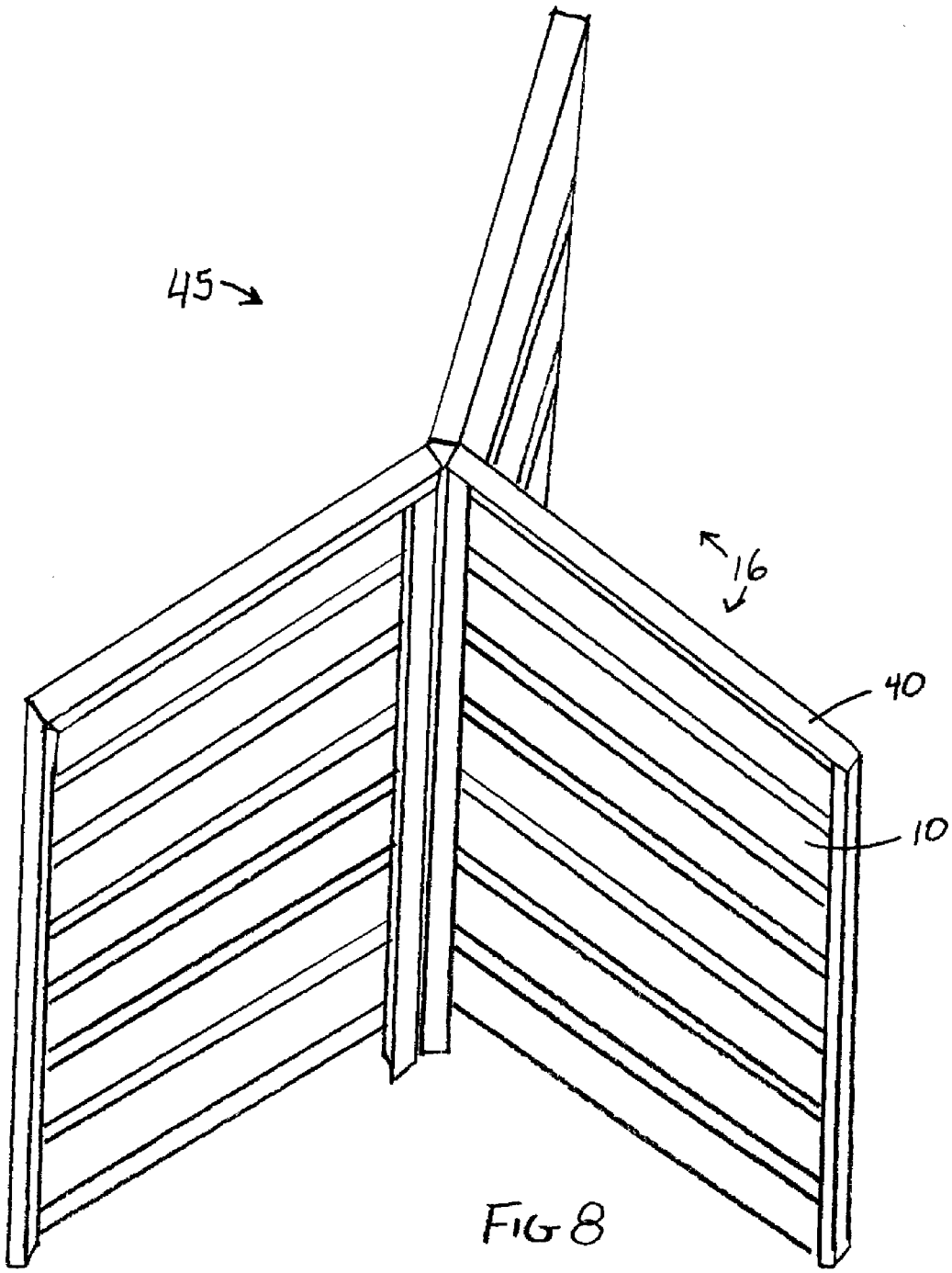
FIG. 8 is a perspective view of a free-standing structure assembled from three framed display panels.

As shown in FIG. 7, the display panel 16 described above may include a frame 40 to provide structure, support and rigidity to the interconnected slat members 10. The frame 40 may include vertically disposed side members 42, horizontally oriented top or bottom members 44, or other frame members attached in any orientation with respect to the display panel 16. The frame 40 may include legs, struts, supports, feet or other structure necessary to support the display panel 16 as a free-standing structure. Alternatively, the frame may facilitate the mounting of a display panel 16 to a building wall or other preexisting structure. The frame 40 may be attached to the individual slat members 10 which form a display panel by any convenient means. For example, slat members 10 may be screwed, bolted, welded, glued, friction-fit or otherwise attached to the frame 40. As shown in FIG. 8, multiple display panels 16 and multiple frames 40 may be combined to create a structure 45 having more than one display panel 16 which is disposed in more than one plane. The structure 45 can be configured in any desired shape, including but not limited to, crosses, triangles, boxes, portable dressing rooms or other shapes. In all embodiments, both the front and back (or the inside and outside surfaces) of a display panel will have hook receiving surfaces provided by the functionality described in detail above.

A display panel 16 having a frame 40 as described in association with FIGS. 7 and 8 is a relatively rigid structure. Thus, framed embodiments are well suited for free-standing displays or for the rigid attachment to a wall. The slat members 10 described herein may also be used to assemble a modular display curtain 46 which is substantially less rigid than the embodiments described above. The reduced rigidity of a display curtain allows it in certain instances to be implemented more quickly, less expensively, and possibly more creatively than the rigid display panels described above.

Figure 9:
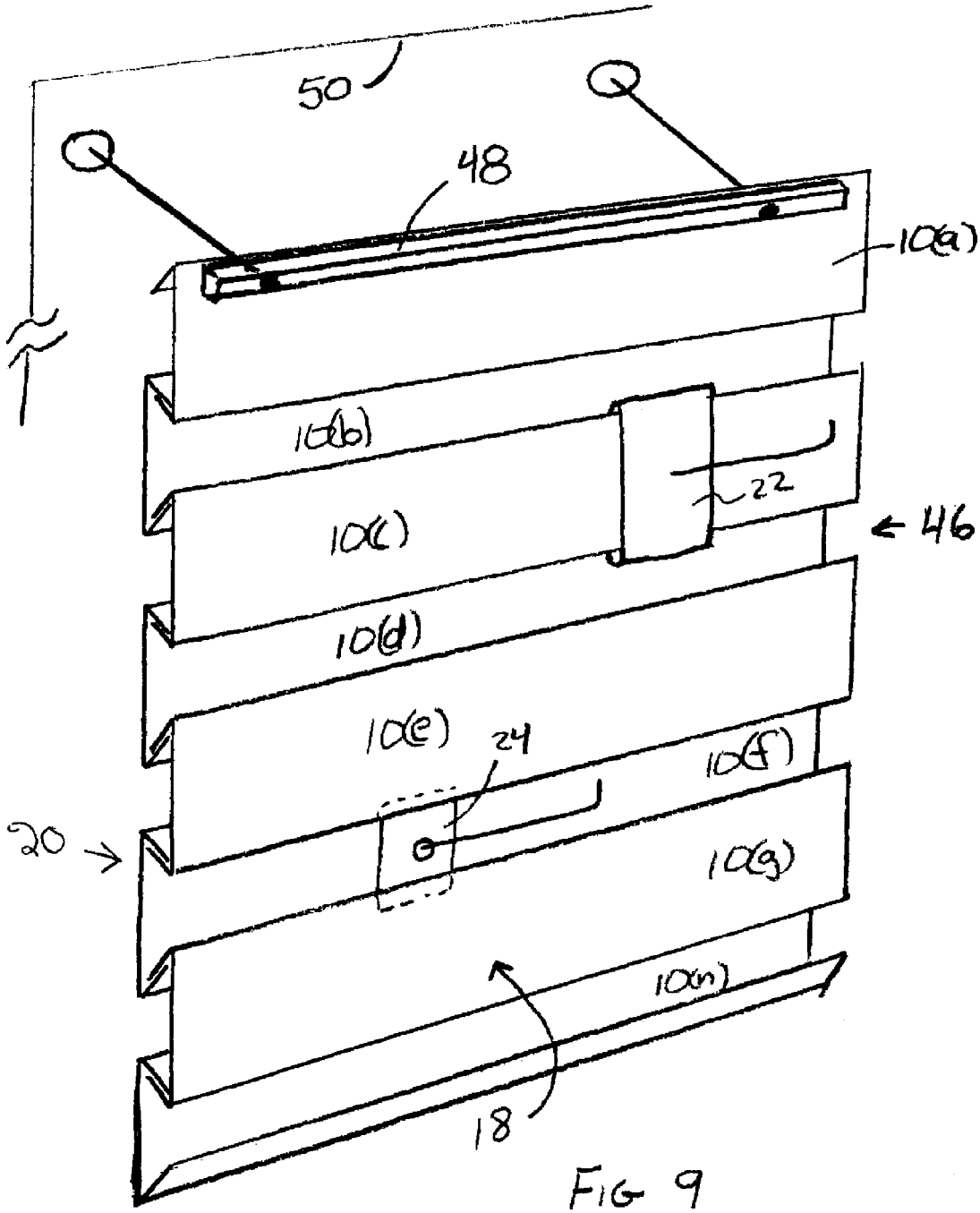
FIG. 9 is a perspective view of a display curtain.

As shown on FIG. 9, a display curtain 46 includes more than one generally horizontally interconnected slat members 10 hung one from another in a generally vertical alignment. The only support necessary for the display curtain, however, is the interconnection between slat members 10 and an attachment 48 connecting the top slat member 10(*a*) to a structure, for example, wall 50. Thus, in the display curtain 46 embodiment, slat members 10 interconnected below the top slat member 10(*a*) may hang freely. Alternatively, the bottom slat member 10(*n*) may, if desired, be similarly attached to a structure with a bottom attachment.

The hooks used to attach merchandise or other items to the display curtain 46 can be any of the types described above, including grid wall hooks 22, slatwall hooks 24 or other hook styles. The display curtain 46 may be attached to a ceiling, doorjamb, wall or other structure which may, if desired, allow both sides of the display curtain to be accessed. If the slat members 10 used to assemble the display curtain 46 are suitably shaped, the display curtain 46 will be double-sided and have opposing front and back hook receiving surfaces 18 and 20 respectively.

Figure 10:
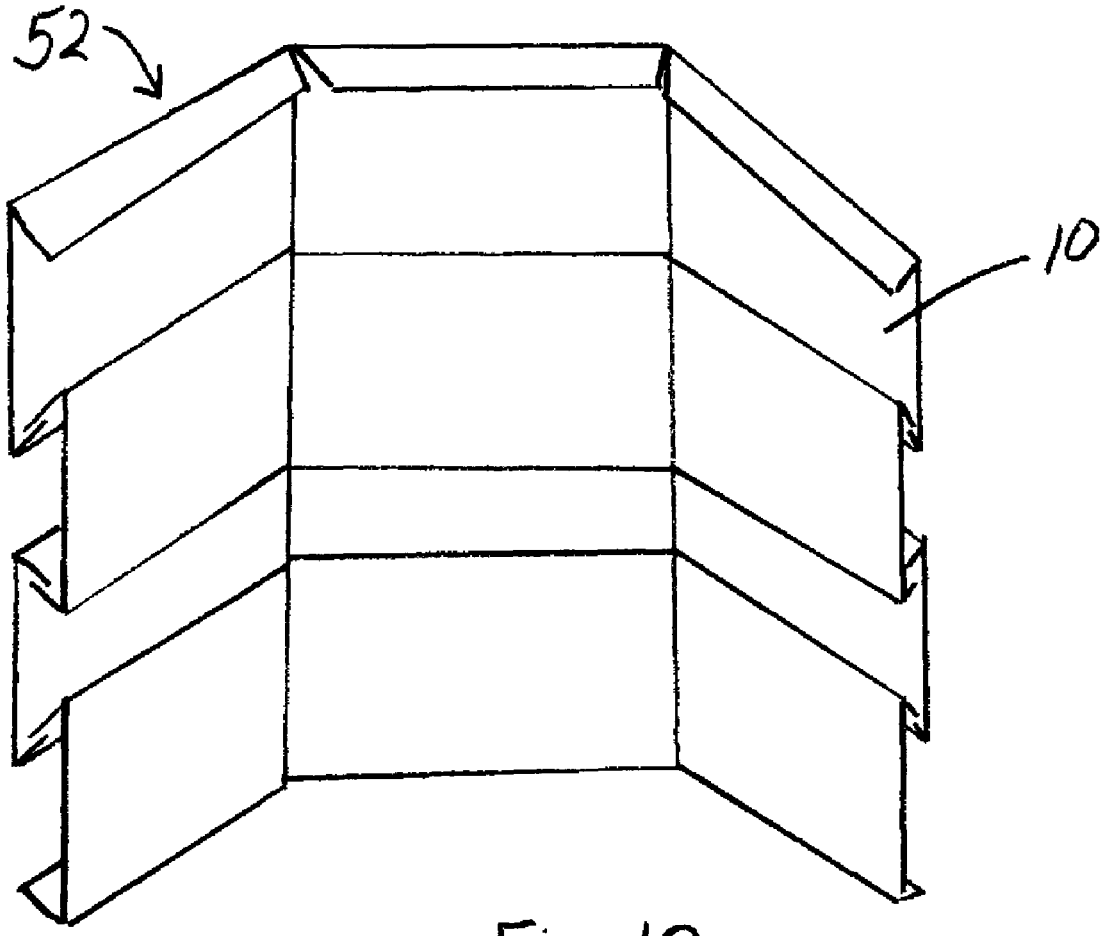
FIG. 10 is a perspective view of a frameless display structure assembled from slat members bonded together.

The flexibility of a display curtain 46 is enhanced if the various slat members 10 are merely frictionally coupled one to another. Alternatively, a more rigid, but still frameless structure may be created by connecting adjacent slat members to each other with screws, bolts, adhesives, a welded joint, rivets, a crimp or other known fastening means. In addition, a frameless free-standing structure 52 as shown in FIG. 10 may be created from multiple slat members 10 provided the slat members are coupled together and arrayed in more than one plane. The frameless structure 52 may be fabricated in any shape desired including, but not limited to, a box, cross, triangle, portable dressing room or other suitable shape.

The various embodiments described in detail above are particularly well suited for the presentation or display of merchandise or other items in a mobile or temporary setting. For example, a structure such as shown in FIG. 8 may be a part of a tradeshow booth useful for the temporary display of merchandise. In use, an appropriate number of slat members 10, horizontal top and bottom frame members 46 and vertical side members 42 may be transported as discrete modular components to the tradeshow location. The frame 40 may be assembled before or after the slat members 10 are interconnected to create display panels 16. The necessary display panels may be assembled by serially interconnecting the upper engagement portion 12 over the lower engagement portion 14 of adjacent slat members 10. As noted above, interconnection of the slat members 10 may be accomplished by merely hooking one over the other without requiring that slat members 10 be slid transversely with respect to each other. The display panel 16 may be attached to a frame 40 as the various slat members 10 are interconnected, or after all slat members 10 of a given display panel 16 are assembled. Subsequently, the display panel 16 and associate frames 40 may be assembled to form a more complex structure which may be a free-standing structure.

The slat members described in detail above may be fabricated by any means known in the material fabrication arts. The slat members may be readily manufactured by bending or forming sheet metal materials. Alternatively, slat members may be extruded from metal, plastic, composite or other materials. Slat members consistent with the various embodiments may also be milled, machined or assembled from discretes of components.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims.

The description of the present invention has been presented for purposes of illustration and description, but is not intended to be exhaustive or limiting of the invention to the form disclosed. The scope of the present invention is limited only by the scope of the following claims. Many modifications and variations will be apparent to those of ordinary skill in the art. The embodiment described and shown in the figures was chosen and described in order to best explain the principles of the invention, the practical application, and to enable others of ordinary skill in the art to understand the invention for various embodiments with various modifications as are suited to the particular use contemplated.

What is claimed is:

1. A modular double sided display panel comprising:

a plurality of slat members with each slat member comprising an upper engagement portion and a lower engagement portion wherein each of the plurality of slat members consists essentially of a base and two sides extending from the base at an acute angle such that each slat member has a partial trapezoidal cross section which is open opposite the base;

a serial interconnection between select adjacent slat members wherein the lower engagement portion of a first slat member is engaged with the upper engagement portion of an adjacent second slat member without sliding either slat member transversely; and opposing front and back hook receiving surfaces defined by the interconnected slat members.

2. The modular double sided display panel of claim 1 wherein each of the plurality of interconnected slat members has a substantially identical cross sectional profile.

3. The modular double sided display panel of claim 1 further comprising a frame operatively associated with the plurality of interconnected slat members.

4. The modular double sided display panel of claim 3 wherein the frame comprises a free-standing structure.

5. The modular double sided display panel of claim 4 wherein the free-standing structure comprises more than one display panel.

6. The modular double sided display panel of claim 5 wherein the free-standing structure comprises more than one display panel disposed in more than one plane.

7. The modular double sided display panel of claim 1 wherein the serial interconnection between select adjacent slat members requires the base of the adjacent slat members to face in opposite directions.

8. The modular double sided display panel of claim 1 further comprising at least one hook received in the front hook receiving surface and at least one hook received in the back hook receiving surface.

9. The modular double sided display panel of claim 1 wherein the opposing front and back hook receiving surfaces defined by the interconnected slat members have a substantially identical cross sectional profile.

* * * * *